United States Patent [19]

Excellente

[11] Patent Number: 4,919,029

[45] Date of Patent: Apr. 24, 1990

[54] ASYMMETRIC INSERT LOADED STRINGED INSTRUMENT

[76] Inventor: Richard Excellente, 19 Marc Dr., Howell, N.J. 07731

[21] Appl. No.: 295,441

[22] Filed: Jan. 10, 1989

[51] Int. Cl.[5] ..... G10D 1/08

[52] U.S. Cl. ..... 84/291; 84/267

[58] Field of Search ..... 84/267, 290–293

[56] References Cited

U.S. PATENT DOCUMENTS

| | | | |
|---|---|---|---|
| D. 297,146 | 8/1988 | Petschulat | D17/20 |
| 4,290,336 | 9/1981 | Peavey | 84/291 |
| 4,334,452 | 6/1982 | Morrison et al. | 84/1.16 |
| 4,362,079 | 12/1982 | Kelly | 84/291 |
| 4,538,497 | 9/1985 | Smith | 84/291 |
| 4,635,522 | 1/1987 | Excellente | 84/291 |
| 4,741,238 | 5/1988 | Carriveah | 84/291 |

*Primary Examiner*—Lawrence R. Franklin

*Attorney, Agent, or Firm*—Omri M. Behr

[57] ABSTRACT

The tonal body disparity between low and high frequency in a stringed instrument and the like may be balanced out by providing asymmetrical mass loading wherein a larger mass is provided to the side of the guitar having strings of high frequency than to the other side. This may be achieved by actual embedding a rigid mass of density greater than that of the body of the instrument into said body.

16 Claims, 5 Drawing Sheets

ASYMMETRIC INSERT LOADED STRINGED INSTRUMENT

BACKGROUND OF THE INVENTION

It is well known that in stringed instruments, suitably guitars, particularly electric guitars which may have solid bodies, the sonant quality of the volume and tone produced by the low frequency strings is superior to that produced by the high frequency strings. In conventional electric guitars, low frequency, multiple wound core strings are generally of substantially greater density per unit length than thinner diameter, single core high frequency strings. Heretofore, it has not been possible to equalize the tone quality of the strings while maintaining the other desired qualities of pitch, ease of playing, and the like. The purpose of the present invention is to provide a guitar of such qualities.

The basic problem was solved by applicant's U.S. Pat. No. 4,635,522 by building the instrument, suitably a guitar, with a rigid unsymmetrical mass loading wherein a larger mass is provided to the side of the guitar proximal to strings of high frequency then to the other side. This was achieved by actually peripherally mass loadinga conventional guitar, building a guitar with a cross-section substantially resembling a tear-drop, the narrow portion of the tear-drop being proximal to the strings of lowest frequency, said cross-section being taken in a plane substantially perpendicular to the upper surface of the guitar and perpendicular to the principal longitudinal axis of the neck of the guitar or a combination thereof.

Peripheral edge loading is effective; however, the cosmetic effect may be undesirable to some players. Furthermore, the external metal edge may cause discomfort to some players when in contact with bare skin.

SUMMARY OF THE INVENTION

It is the surprising finding of the present invention that the resonant qualities of the strings of high frequency in stringed instruments can be substantially improved by the unsymmetrical mass loading of a rigid insert embedded into the body of the instrument proximal to the strings of high frequency by substantially any means, not only by providing a rigid metallic rim whose weight distribution is greater proximal to said strings as in U.S. Pat. No. 4,635,522.

Thus in a stringed instrument comprising a body having a front surface and a rear surface, peripheral edges connecting said front and rear surfaces, a neck extending from one end of said body, and strings tensioned over a bridge on the body and the neck in a substantially common plane, there is provided a rigid mass embedded into said body in such a manner suitably with at least 25 or preferrably 50% of the peripheral surface area of said rigid mass is in contact with said body that the resultant mass of the side of body proximal to the strings of highest frequency, is greater than that on the other side distal to said strings of highest frequency to provide asymmetric weight loading of at least 10% suitably about 10 to about 75% of the weight of the instrument prior to said embedding. It is thus within the purview of the invention that the embedded mass may have a surface portion coextensive with or protruding from at least one surface of the instrument. Such embedded mass should, however be independent of the string bridge.

While the invention is not so limited, the improvements herein are particularly effective with instruments having solid or substantially solid bodies. The term substantially solid shall be interpreted to include those instruments which have some cavities therein, suitably for insertion of electronic components or for substantially decorative purposes.

The loading may be achieved by embedding at least one beam into the body of the instrument. The shape of the beam is irrelevant. While cylindrical beams are easiest to handle, the cross sectional area may for example be l, square, rectangular or elliptical. The beam (or beams) may be inserted into the body of the instrument with its axis substantially parallel or perpendicular to the axes of the stringsor any angular orientation between these that seems convenient to the maker.

Alternatively the loading may be achieved by laminating a substantially planar mass into the body of the instrument with its principal plane substantially parallel to the principal plane on which the strings lie, suitably substantially between the front and rear surfaces of the instrument. It is not critical that this mass is planar, it is merely a convenience of construction. Similarly, the term "laminating" is not to be strictly interpreted in its narrow meaning of actually gluing at least two surfaces together. While this mode is again the more structurally convenient, mere surface contact coupled with the use of bolts or similar fastening means is operative.

The nature of the rigid mass is not critical, there may be used metal, ceramic, glass, stone, slate or composites of at least one member of this group with a binding agent, for example in an epoxy resin composite or an autocomposite such as a sinter. Solid masses are preferred. In the mode where the entire insert is enclosed or substantially enclosed and securely held in, even the development of cracks in the material does not appear to have deleterious effects on the desired result.

Enrichment of the entire frequency spectrum may be achieved by arranging the insert to be in contact with the string bridge, preferably with the feet thereof penetrating the surface of the instrument.

Under certain circumstances, i.e., in an electric bass guitar, it may be desirable to enrich the tones of the strings of lower frequency, either because in the mode of playing contemplated, the higher frequencies are not important or an overemphasis on the lower frequency tones is desired. In such an instrument the asymmetrical loading is reversed, that is to say the mass on the side distal to the strings of higher frequency is increased relative to the proximal side.

DETAILED DESCRIPTION OF THE DRAWINGS

Figure 1:
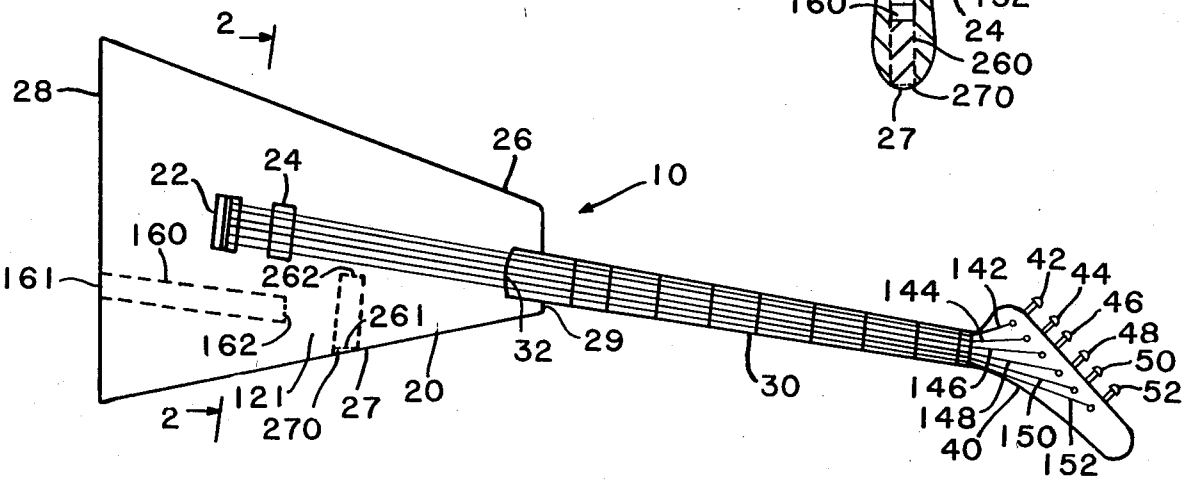
FIG. 1 is a plan view of an embodiment of the novel guitar of the present invention showing an inserted beam in two positions.

The guitar generally designated as 10 is illustrated in FIG. 1. The guitar, as is conventional, comprises a body section 120 having attached thereto a neck 30 to the upper end of which is connected tuning head 40. Body 120 may be constructed, in plan, to substantially any design which is deemed desirable from an esthetic point of view. The tetrahedral-like shape as well as the teardrop cross section shown are purely illustrative of possible designs.

For purposes of convenience the body is designated as having four edges, an upper edge 29, a lower edge 28, and two side edges 27 and 26. The body has an upper surface 21 and a lower surface 23.

At least the upper surface 21 is shallowly convex. If considered as substantially, though not absolute, planar, upper and lower surfaces 21 and 23 subtend an angle of about 10° to about 30° to each other and are connected by a narrow edge surface 26 of a radius which is substantially smaller than that of corresponding wide edge surface 27.

The remaining portion of the guitar is constructed in a substantially conventional manner. Body 20 carries a bridge 22 and a pick-up device 24. End 32 of neck 30 is attached to body 20 proximate to upper edge 29. String tightening units 42, 44, 46, 48, 50 and 52 are embedded in tuning head 40. Strings 142, 144, 146, 148, 150 and 152 are attached at one end thereof to string tightening units 42, 44, 46, 48, 50 and 52 respectively. The lower ends of said strings passes over pick-up device 24 and contact are attached to bridge 22 in the conventional manner. While the illustrated embodiment shows 6 strings, guitars with 4, 10 and 12 strings are known and may be used. An amplifying unit, not shown, may be placed on or in the guitar in the usual manner.

Figure 3:
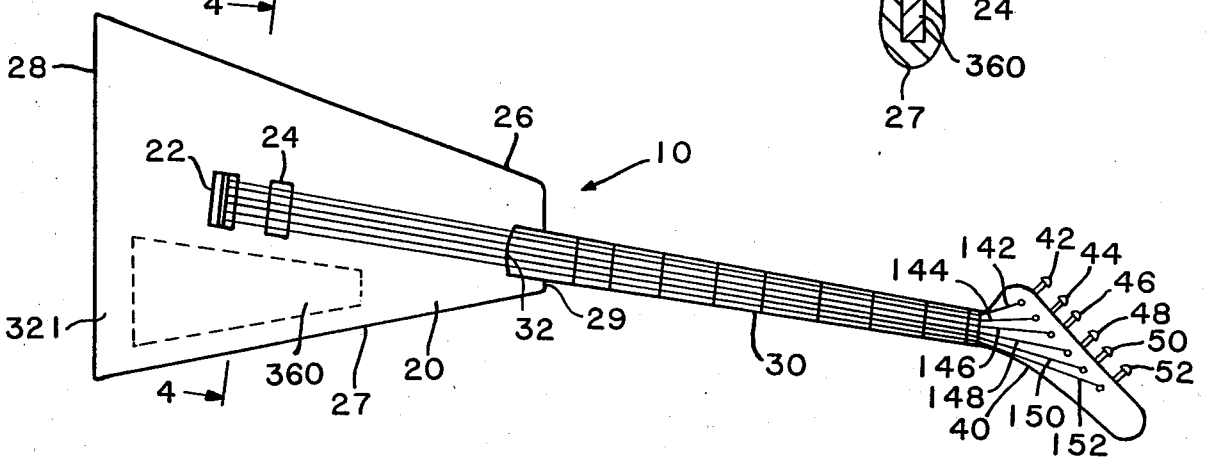
FIG. 3 is a plan view of another embodiment of the novel guitar of the present invention showing the lamination of a plate insert.
Figure 5:
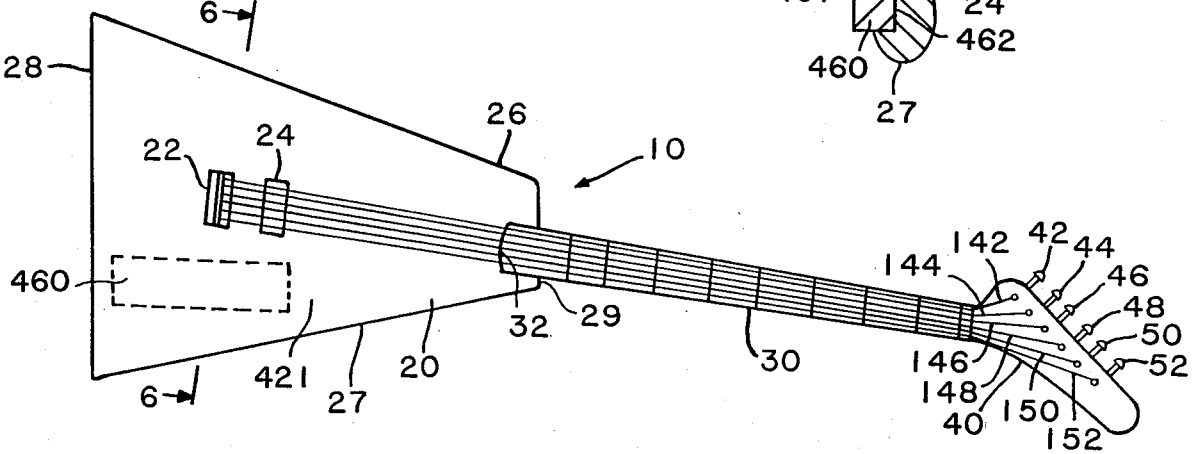
FIG. 5 is a plan view of a further embodiment of a novel guitar of the present invention showing the partial protrusion of an insert from a surface of the guitar.

The asymmetrical loading may alternatively be provided by a beam (two possible positions shown in FIG. 1), two beams (FIG. 7), or a partial or full laminate insert (FIGS. 3 and 5 respectively). The guitar may either be of conventional cross-section, i.e., substantially rectangular or as illustrated above. It will be understood by those skilled in the art that substantial variations are possible in the actual radii of curvature of edge 26 and edge 27. Furthermore, variations are also to be expected in the approximate angle subtended at edge 26 between surfaces 21 and 23.

In guitar construction, the pick-up device 24, with some variation in exact placement, is located substantially midway between edges 26 and 27. It is a basic characteristic of the present invention that the mass of the guitar body 20 shall be greater on the side thereof proximate to edge 27 than on the side thereof proximate to edge 26. This is so whether provided by the structure of FIGS. 1, 3, 5 or 7.

In the conventional construction of guitars and similar stringed instruments, the strings of higher pitch are located on the right-hand side of the bridge (as viewed in downward plan) and the strings of lower pitch are located on the left-hand side of the bridge.

In the embodiment of FIG. 1, asymmetric loading is provided to the guitar body, by a rigid metal beam 160 or 260 (shown in phantom), having internal ends 162 and 262 respectively and external ends 161 and 262 respectively. Either beam 160, oriented substantially parallel to the strings or beam 260, located substantially perpendicular thereto may be utilized. Both may be simultaneously present. In FIG. 1, beam 160 is illustrated as having a cap portion 170 at end 161. This is a purely cosmetic device which is not present on beam 260.

Any rigid material of specific gravity greater than about 2 may be utilized. Aluminum and steel are suitable as are ceramics, glasses and composites including composites embedded in resins or sinters. It is desirable that at least 25, suitably at least 50% of the peripheral area of the insert be in contact with the body of the instrument. The term peripheral surface signifies the surface area given by measurement of the gross parameters rather than that of the individual particles as would be shown in their measurement in sinters.

In yet further embodiments of the invention, in order to obtain tonal effects contemplated by the principal purpose of the present invention, the embedded mass may be embedded in various other ways.

Figure 4:
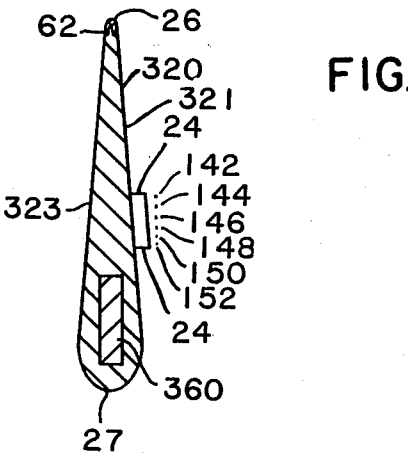
FIG. 4 is an upward elevational view of the bottom edge of the guitar viewed at 4—4 of FIG. 3.

FIGS. 3 and 4 illustrate a particular embodiment of the invention. The last two digits refer to substantially the same items as in FIGS. 1 and 2. The drawings merely illustrate the body containing the inserts in different shapes and locations. The functions are the same in FIGS. 1 and 2. Thus a plate 360 is laminated between surfaces 321 and 323 of body 320.

Figure 6:
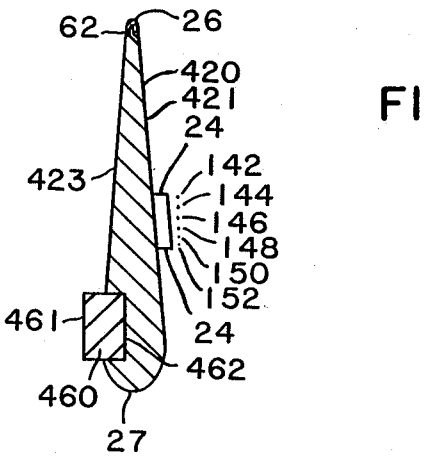
FIG. 6 is a cross sectional view of the guitar viewed at 6—6 of FIG. 5.

FIGS. 5 and 6 illustrate an embodiment similar to that of FIGS. 3 and 4, that is to say, an insert 460 which constructed in a manner substantially similar to that illustrated in FIG. 3 but whose end 461 protrudes below surface 423 of body 420 while segment 462 remains embedded. Again the last two digits refer to substantially the same items as in FIGS. 1 and 2. While such an embodiment is not illustrated, the invention contemplates an embodiment of these figures wherein the central segment of insert 460 is embedded in body 420 whilst both end segments 461 and 462 protrude from surfaces 421 and 423 respectively.

Figure 2:
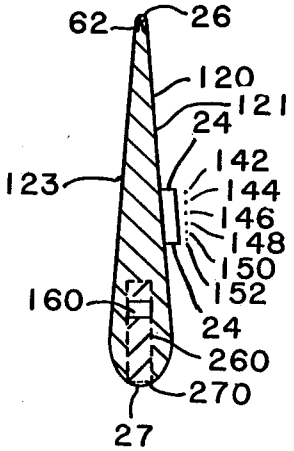
FIG. 2 is a cross-sectional view of the guitar viewed at 2—2 of FIG. 1.
Figure 8:
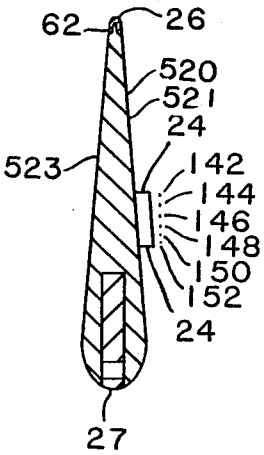
FIG. 8 is a cross sectional view of the guitar viewed at 8—8 of FIG. 7.
Figure 7:
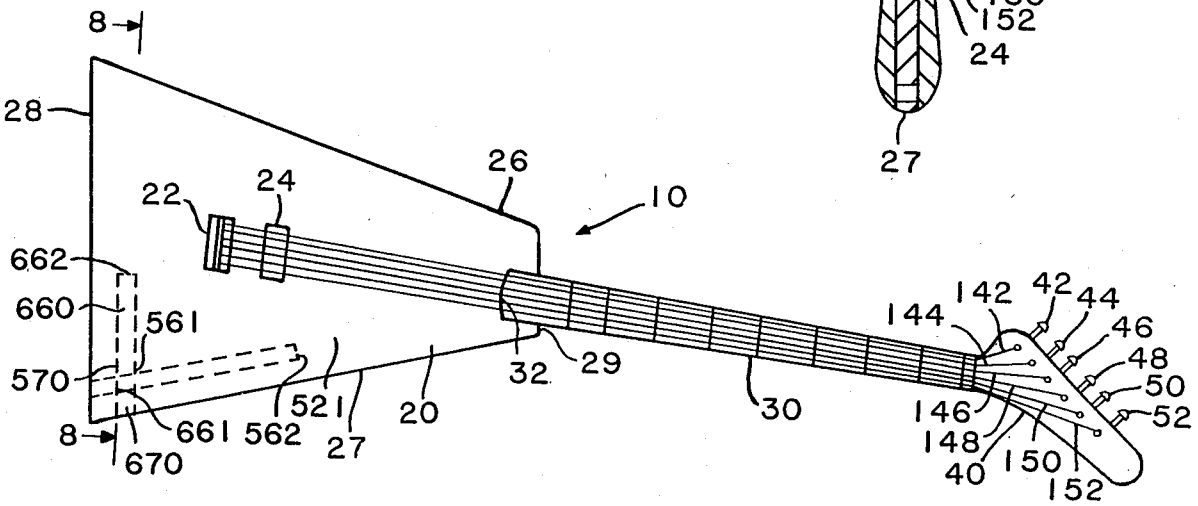
FIG. 7 is a plan view of a further embodiment of a novel guitar of the present invention showing the embedding of two beams at different angles.

FIGS. 7 and 8 illustrate an embodiment similar to that of FIGS. 1 and 2, that is to say, two beam inserts 560 and 660 which are constructed in a manner substantially similar to that illustrated in FIG. 13 but which are placed within body 520 between surfaces 521 and 523 of body 520 in such a manner that the former is substantially parallel to edge 527 while the other is substantially parallel to edge 526. Again the last two digits refer to substantially the same items as in FIGS. 1 and 2.

Figure 10:
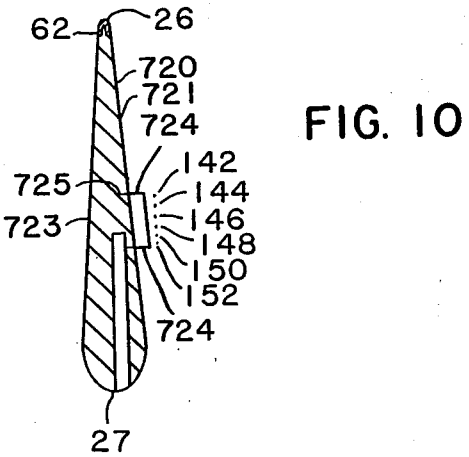
FIG. 10 is a cross sectional view of the guitar viewed at 10—10 of FIG. 7.
Figure 9:
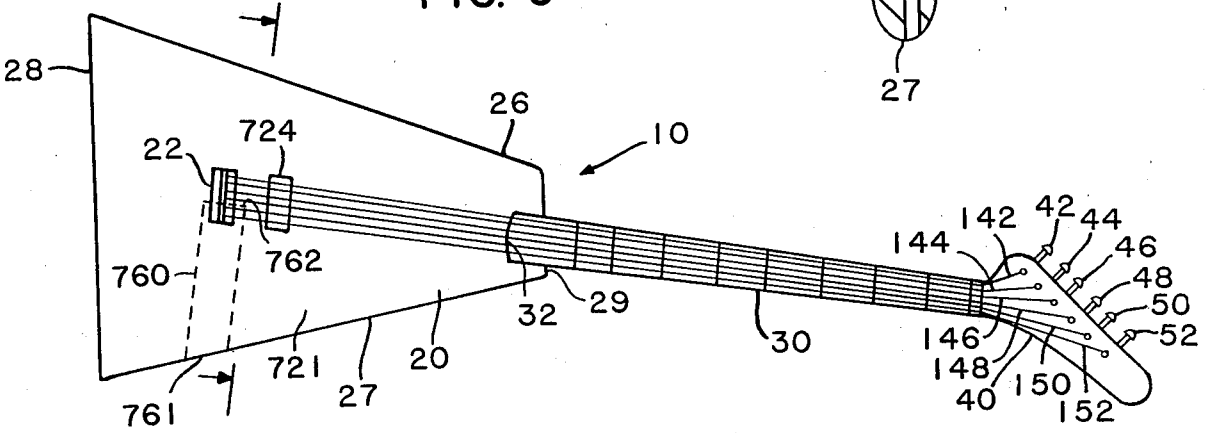
FIG. 9 is a plan view of a further embodiment of a novel guitar of the present invention showing the embedding of one beam contacting the bridge.

FIGS. 9 and 10 illustrate a particular embodiment of the invention. The last two digits refer to substantially the same items as in FIGS. 1 and 2. The drawings illustrate a further, tonally modifying arrangement. In this embodiment the bridge 724 may have feet 725 which penetrate surface 721. The beam 760 is inserted into the body in such a manner that end 762 contacts at least one foot 725. This modification provides not only the effect of asymmetric loading but also a greater depth of tone throughout the frequency spectrum.

The effect of producing asymmetric loading proximal to edge 26 rather than edge 27 would be to accentuate the tonal imbalance whereby the low frequency strings have a fuller tone than the high frequency strings. While under most circumstances this is generally considered to be an undesirable effect, certain musicians may intend such deliberate distortions in order to achieve tonal effects which they personally desire.

The pitch of the strings may be determined either by the density per unit length of the string or by the tension placed upon it, or a combination thereof. Thus, it is entirely possible to utilize strings of equal diameter and obtain the conventional one octave spread of basic frequency purely by means of adjusting the tension on the strings. This procedure however is not usual since it in fact involves under-tensioning the strings of the lowest frequency and over-tensioning the strings of the highest frequency. It is more conventional to utilize high density strings in, for example, position 142 and low density strings in position 152. The materials utilized for the strings may vary but in electric guitars a nickel/steel ribbon wrapped over a wire core type of string is used in positions 142, 144 and 146 and a single strand comparatively low diameter wire is used in positions 148, 150 and 152.

While the illustrated examples in the present specification is a guitar, the invention and its principles are not so limited. The invention is intended to include all stringed instruments, especially solid bodied ones, having strings which are plucked or stroked and laid across a sounding board or body.

What is claimed is:

1. In a stringed instrument comprising a solid body having a front surface and a rear surface, peripheral edges connecting said front and rear surfaces, a neck extending from one end of said body, and strings tensioned on the body over a bridge and a neck in a substantially common plane, the improvement comprising:

a rigid mass of density greater than that of said body at least partially embedded in said body in such a manner that at least 50% of the peripheral surface area of said rigid mass is in contact with said body and in such a manner that the resultant mass of the side of said body proximal to the strings of highest frequency is greater than that on the other side distal to said strings of highest frequency to provide asymmetric weight loading of at least 10% of the weight of the instrument prior to said embedding.

2. An instrument of claim 1 wherein said instrument is a guitar.

3. An instrument of claim 1 wherein asymmetric weight loading is between 10 and 75% of the original weight of the instrument.

4. An instrument of claim 1 wherein the loading is achieved by embedding at least one beam into the body of the instrument.

5. An instrument of claim 1 wherein the loading is achieved by embedding at least one beam into the body of the instrument with its axis substantially parallel to the axes of the strings.

6. An instrument of claim 1 wherein the loading is achieved by embedding at least one beam into the body of the instrument with its axis substantially perpendicular to the axes of the strings.

7. An instrument of claim 1 wherein the loading is achieved by embedding at least two beams into the body of the instrument with their axes at different angles to the axes of the strings.

8. An instrument of claim 1 wherein the loading is achieved by embedding a substantially planar mass into the body of the instrument with its principal planes substantially parallel to the principal plane on which the strings lie.

9. An instrument of claim 1 wherein the loading is achieved by laminating a substantially planar mass into the body of the instrument with its principal plane substantially between the front and rear surfaces of the instrument.

10. An instrument of claim 1 wherein a portion of the said mass protrudes from the surface of the instrument.

11. An instrument of claim 1 wherein the rigid mass is selected from the group consisting of metal, ceramic, glass, stone, slate or composites of at least one member of this group.

12. An instrument of claim 11 wherein said rigid mass is one of said composites which further comprises a binding agent.

13. An instrument of claim 1 wherein said bridge is in contact with said mass.

14. An instrument of claim 13 wherein said bridge has feet which penetrate the upper surface of the instrument, said feet contacting said mass.

15. In a stringed instrument comprising a body having a front surface and a rear surface, peripheral edges connecting said front and rear surfaces, a neck extending from one end of said body, and strings tensioned on the body and a neck in a substantially common plane, the improvement comprising:

a rigid mass of density greater than that of said body at least partially embedded in said body in such a manner that at least 50% of the peripheral surface area of said rigid mass is in contact with said body and in such a manner that the resultant mass of the side of said body distal to the strings of highest frequency is greater than that on the other side proximal to said strings of highest frequency to provide asymmetric weight loading of at least 10% of the weight of the instrument prior to said embedding.

16. An instrument of claim 15 wherein the said body is substantially solid.

* * * * *